US010687134B2

(12) United States Patent
Davi et al.

(10) Patent No.: US 10,687,134 B2
(45) Date of Patent: Jun. 16, 2020

(54) DISCONNECTABLE CONNECTOR WITH PROVISIONS FOR MOTION IN TWO AXES

(71) Applicants: Davi Audio, Longwood, FL (US); William R. Moseley, Mooresville, NC (US)

(72) Inventors: Leonard Davi, Longwood, FL (US); Jason May, Converse, TX (US); Todd Metlen, Ojai, CA (US); William Moseley, Rodessa, LA (US); Demian Martin, San Leandro, CA (US)

(73) Assignee: Davi Audio, Inc., Longwood, FL (US)

( * ) Notice: Subject to any disclaimer, the term of this patent is extended or adjusted under 35 U.S.C. 154(b) by 0 days.

(21) Appl. No.: 15/799,366

(22) Filed: Oct. 31, 2017

(65) Prior Publication Data

US 2019/0132664 A1 May 2, 2019

Related U.S. Application Data

(60) Provisional application No. 62/416,148, filed on Nov. 1, 2016.

(51) Int. Cl.

| | |
|---|---|
| ***H04R 1/10*** | (2006.01) |
| ***H01R 13/512*** | (2006.01) |
| ***H01R 13/73*** | (2006.01) |
| ***H01R 13/516*** | (2006.01) |
| ***H01R 13/633*** | (2006.01) |
| ***H01R 24/84*** | (2011.01) |
| *H01R 13/645* | (2006.01) |

(52) U.S. Cl.

CPC ..... *H04R 1/1008* (2013.01); *H01R 13/512* (2013.01); *H01R 13/516* (2013.01); *H01R 13/633* (2013.01); *H01R 13/73* (2013.01); *H01R 24/84* (2013.01); *H04R 1/105* (2013.01); *H04R 1/1066* (2013.01); *H01R 13/645* (2013.01)

(58) Field of Classification Search

CPC .... H01R 41/00; H01R 13/516; H01R 4/5025; H04R 1/1008; H04R 1/105; H04R 1/1066

See application file for complete search history.

(56) References Cited

U.S. PATENT DOCUMENTS

| | | | | |
|---|---|---|---|---|
| 4,779,067 | A * | 10/1988 | Johanson | H01R 24/40 333/156 |
| 5,931,681 | A * | 8/1999 | Thomassin | B64D 15/12 439/25 |
| 6,830,491 | B1 * | 12/2004 | Tomasino | H01R 4/5033 439/322 |
| 8,170,261 | B2 | 5/2012 | Danielson et al. | |
| 9,614,304 | B2 * | 4/2017 | Melni | H01R 4/56 |

* cited by examiner

*Primary Examiner* — Ross N Gushi

(74) *Attorney, Agent, or Firm* — Michael L. Leetzow, P.A.

(57) ABSTRACT

A connector is disconnectable from the device, yet providing stable connections and allowing one side of the connection to rotate about an axis through the connection and move longitudinally along the axis. One embodiment is a set of headphones allowing for the owner to select various configurations of the headband and ear cups.

4 Claims, 6 Drawing Sheets

DISCONNECTABLE CONNECTOR WITH PROVISIONS FOR MOTION IN TWO AXES

REFERENCE TO RELATED CASE

This application claims priority under 35 U.S.C. § 119 (e) to provisional application No. 62/416,148 filed on Nov. 1, 2016, contents of which are hereby incorporated by reference in their entirety.

BACKGROUND OF THE INVENTION

Field of the Invention

There are countless numbers and types of mating and disconnectable electrical connectors available today. They may or may not have at least some form of outer protective housing.

Most connectors are stationary and do not move by design, but there are a limited number that allow for circular rotation of the components relative to one another.

Examples of mating stationary connector designs are used on printed circuit boards, panel/chassis mounted, or cable end terminations designed for AC or DC power, audio, video, computers, communications, RF, etc. The connectors may be a locking type, but are not designed to rotate axially (about an axis through the connector) or move longitudinally (along the same axis) without disconnecting.

Examples of circular rotating connectors are: telephone handset cords, motor brush contacts, instrumentation sensors, or probes, etc. These connectors are mostly designed to not disconnect or move longitudinally. Rather, they are designed to rotate continually and with little effort. Rotating connectors are more subject to connection stability and signal integrity problems.

Thus, a connector that allows for some rotation and longitudinal movement is need.

SUMMARY OF THE INVENTION

The present invention is directed to a disconnectable connector that includes an upper shaft portion configured at a first end to be attached to a headband, a lower shaft portion configured at a first end to be attached to an ear cup support and having at a second end one portion of a push-pull connector, an inner shaft housing having an opening therethrough for the passage of electrical wires, the inner shaft housing having a first part of an electrical connector disposed in the opening at a first end and connectable to the electrical wires, a rotational stop disposed at a second end, and a second portion of the push-pull connector at the first end, and an adjustment member extending between a first end and a second, the adjustment member having an opening defined by an inside surface that extends from the first end to the second end, a portion of the upper shaft disposed within the opening at the first end and a portion of the inner shaft housing disposed within the opening, the inside surface having at least one set of threads therein, whereby the upper shaft portion moves away from the first end of the inner shaft housing when the adjustment member is rotated a first way and toward the first end of the inner shaft housing when the adjustment member is rotated a second way.

In some embodiments, the inner shaft housing extends through the adjustable member and into an opening in the upper shaft portion.

In some other embodiments, the inner shaft has at least one rotational stop member, the at least one rotational stop receiving member to engage the rotational stop in the inner shaft housing.

It is to be understood that both the foregoing general description and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention and, together with the description, serve to explain the principles and operations of the invention.

DETAILED DESCRIPTION OF THE PREFERRED EMBODIMENTS

Figure 1:
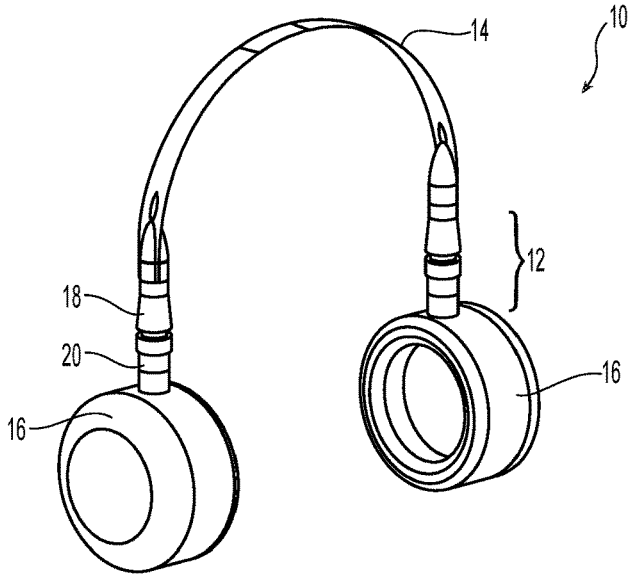
FIG. 1 is one embodiment of a set of headphones that could be used with the connector according to the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Disconnectable connectors work best when they are mated within or with rigid housings due to the added support that they may need. Most connectors require precise positioning and positive latching to maintain a good electrical connection, but this imposes significant limitations on mounting.

In some applications, the connector housing also is a part of a mechanical system that needs to be adjustable in multiple axis. It is difficult to find connection options when the connector and housing are part of a device that require 1) a positive lock mating, 2) high quality connection stability and signal integrity, 3) disconnectability, 4) movement in both axial and longitudinal directions, and 5) have a damped movement.

In the present invention, one such device is a set of headphones. Typically, headphones come in generally one-size-fits all, regardless of the size of the purchaser. Sure there are a few adjustments that can be made to the headband of the headphones, but that rarely makes for a good fit. It would be better if the headband were interchangeable with the ear cups (where the sound originates from) so the head band would fit the owner—so the ear cups need to be disconnectable. Then it would be nice if the ear cups could move relative to the headband—both in a rotational direction (around an axis that passes essentially parallel to the owner's head and through the connector and ear cups) and a longitudinal direction—so that ear cups can fit over the ears of the owner. The present invention has elements that provide the disconnectability and relative motion, while at the same time providing a robust connector that allows the signals to pass to the ear cups unaltered.

Figure 2:
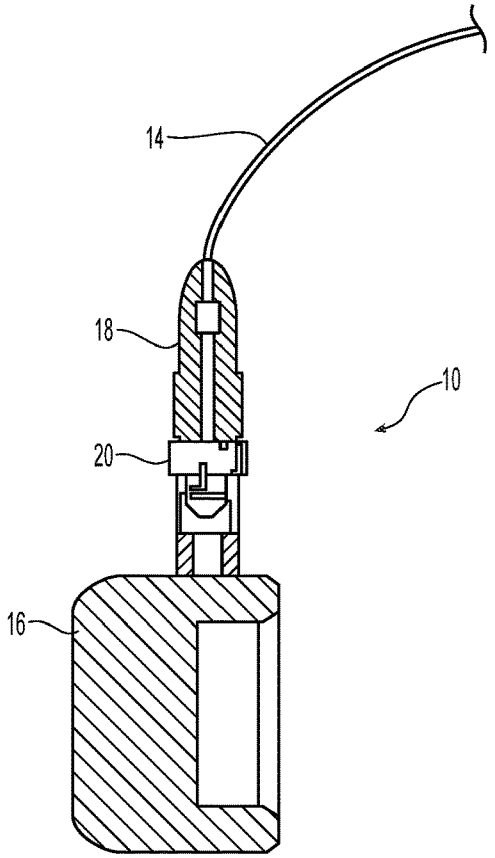
FIG. 2 is a cross section of one of the connectors on the set of headphones in FIG. 1 in a connected state.
Figure 3:
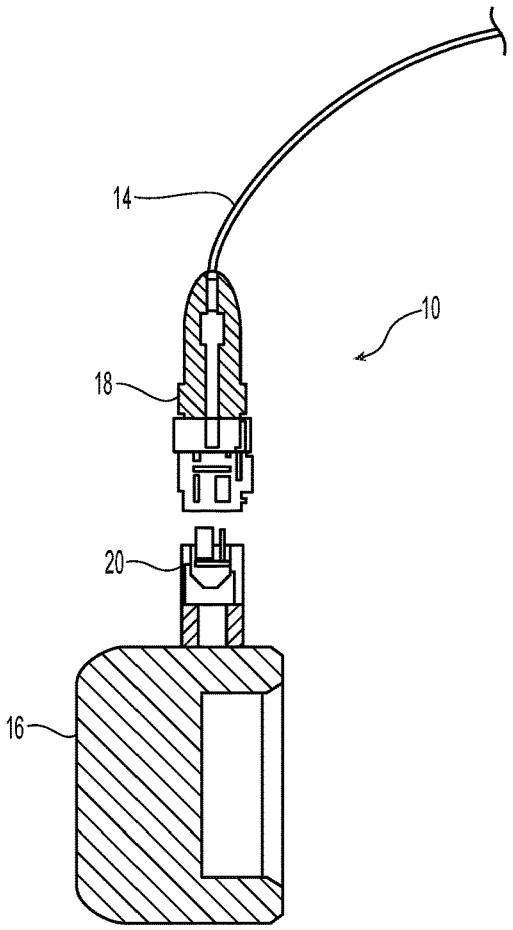
FIG. 3 is a cross section of one of the connectors on the set of headphones in FIG. 1 in a unconnected state.
Figure 5:
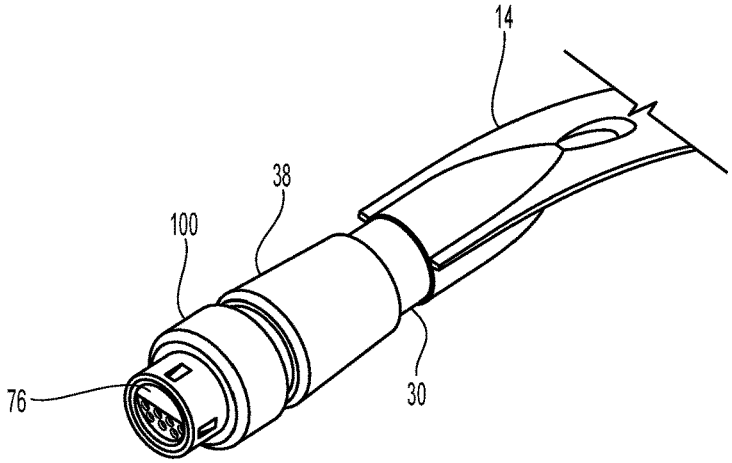
FIG. 5 is a perspective view of one embodiment of the upper shaft portion of the connector of FIG. 1.

Referring to the figures, there is a set of headphones 10 that contains the connector 12 according to the present invention. Headphones 10 has a headband 14 and two ear cups 16. An extension or other arm could be disposed between the connector 12 and the ear cups 16 and still fall within the scope of the present invention. The connector 12 includes an upper shaft portion 18 and a lower shaft portion 20. The upper shaft portion 18 is disconnectable from the lower shaft portion 20. See, e.g., FIGS. 2 and 3. Illustrated in the figures, is a generic headband 14. The headband 14 may be made of any materials, have any configuration, be adjustable, etc. The headband 14 may be connected directly to the connector 12 or there may be more structure disposed between the headband 14 in the connector 12. This is discussed in more detail below.

The ear cups 16 are illustrated as a generic set of ear cups. The connector 12 may be connected/attached directly to the ear cups 16 where there may also be intervening structures between the connector 12 and the ear cups 16. This too will be discussed in more detail below.

Figure 4:
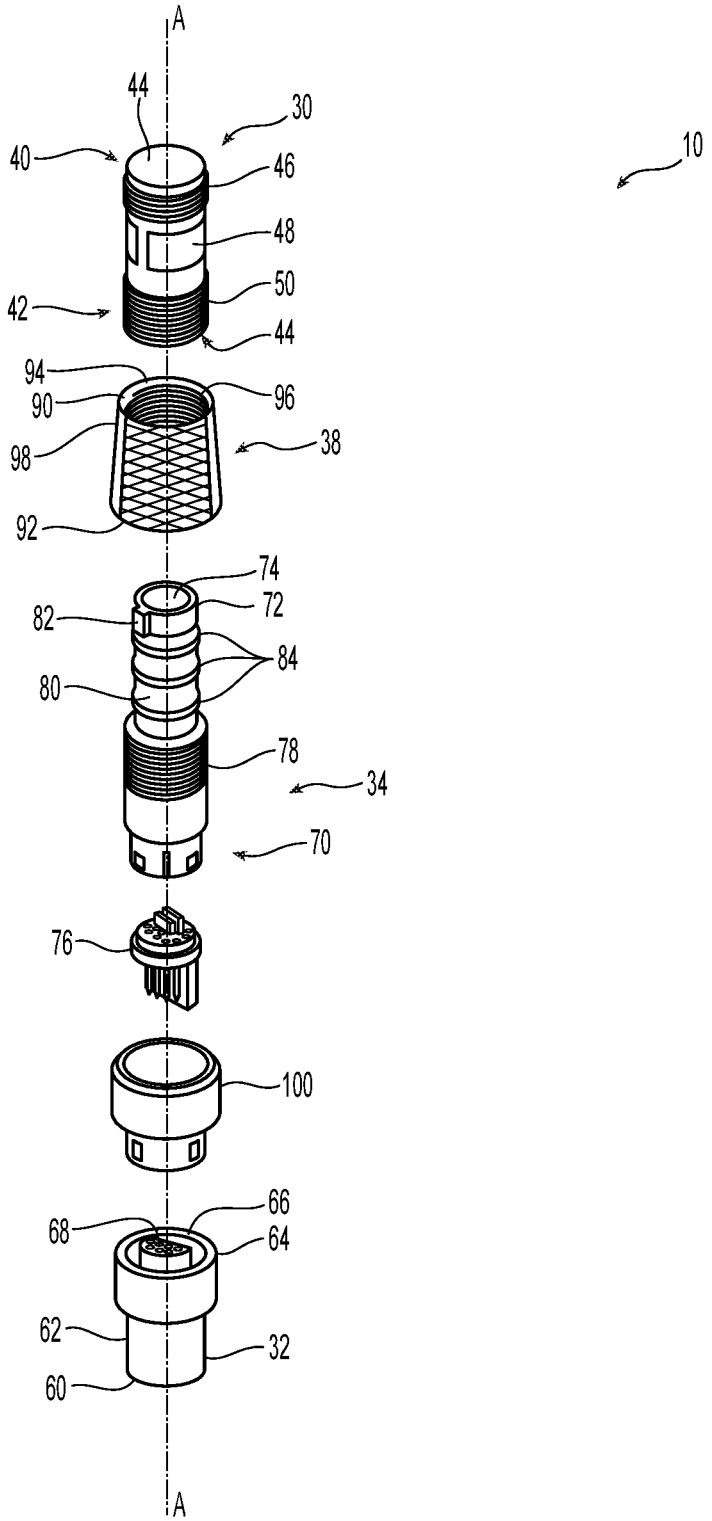
FIG. 4 is an exploded view of the connector housings use with the set of headphones in FIG. 1.
Figure 7:
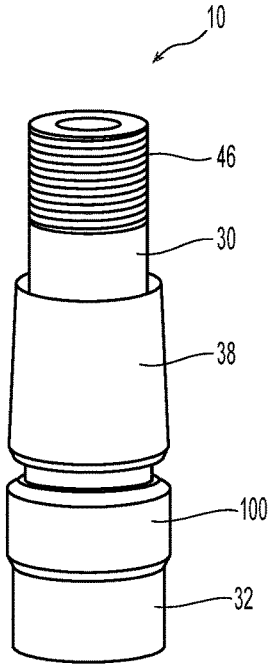
FIG. 7 is an elevational view of in alternative embodiment of an upper shaft portion of a connector according to the present invention.

The connector 12 will now be discussed with reference to FIG. 4. The connector 12 includes an upper shaft portion 30, a lower shaft portion 32, an inner shaft portion 34, and an adjustment member 38. As illustrated in FIG. 4, there is an axis A that extends longitudinally through the connector 12. As noted before, the upper shaft portion 30 connects to the headband 14 and the lower shaft portion 32 connects to the ear cup 16 (or associated structure). The upper shaft portion 32 preferably has a first end 40 and a second end 42, the upper shaft portion having an opening 44 from the second end 42. The first end 40 has a threaded portion 46 to engage the headband or a structure that could be attached to the headband 14. See also FIG. 7. The upper shaft portion 30 also includes at least one rotational stop receiving member 48. The at least one rotational stop receiving member may include a milled section in the opening 44 or stop pins or projections in the opening to engage a rotational stop on the inner shaft portion 34 described below.

The upper shaft portion 30 also has a threaded portion 50 at the second end 42 to engage the adjustment member 38, which will be described in more detail below.

Figure 6:
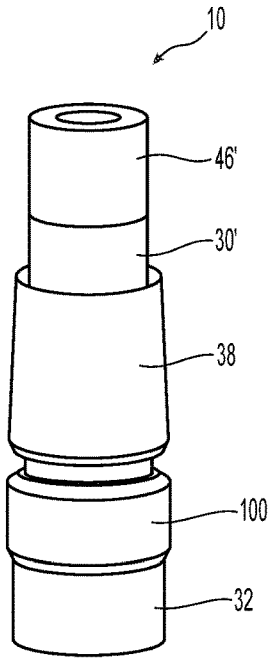
FIG. 6 is an elevational view of the upper shaft portion a FIG. 4.

As illustrated in FIG. 6, where an alternative embodiment of the upper shaft portion 30' is illustrated, there may be a surface 46' that is not threaded. Rather, surface 46' may be a flat surface that allows for the connector 12 to be press-fit into the headband 14 or other structure.

Figure 8:
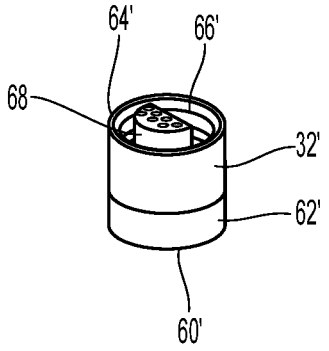
FIG. 8 is a perspective view of one embodiment of a lower shaft portion of the connector used with a set of headphones in FIG. 1.
Figure 9:
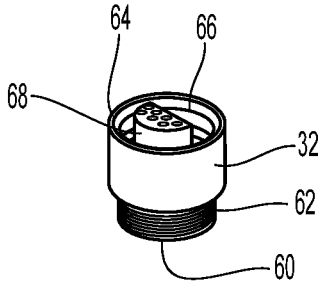
FIG. 9 is a perspective view of an alternative embodiment of a lower shaft portion of the connector use with a set of headphones in FIG. 1.
Figure 10:
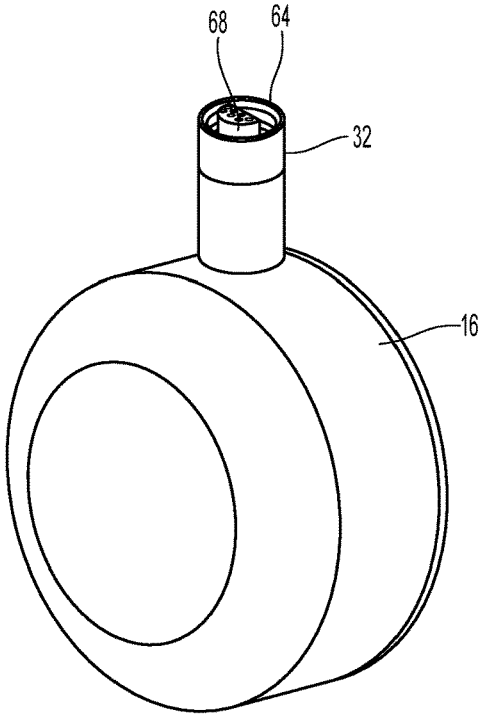
FIG. 10 is a perspective view of the lower shaft portion attached to and ear cup support.

The lower shaft portion 32 has a first end 60 to be attached to the ear cups 16 either by threads 62 at the first end 60 (see also FIG. 9) or by a smooth portion 62' at first end 60' in the alternative embodiment 32' in FIG. 8. The smooth portion 62' would be press-fit into a corresponding opening in the ear cup 16. As with the upper shaft portion and headband, the lower shaft portion and ear cups may be attached directly to one another or have an intervening structure. Either way, the configuration falls within the scope of the present invention.

At the second end 64 is an opening 66 with a first electrical connector 68 fixedly attached with the opening 66. Preferably the electrical connector 68 is keyed to mate with a corresponding second electrical connector. The second end 64 also is configured to be one portion of a push/pull connector. While Lemo® brand connectors and configurations are probably the best known type of push/pull connector, other similar connector configurations can be used as well.

The connector 10 also has an inner shaft housing 34, which really functions as a bridge between the upper shaft portion 30 and the lower shaft portion 32. The inner shaft housing 34 has a first end 70, a second end 72, and an opening 74 that extends through the inner shaft housing 34 from the first to the second ends 70,72. At the first end 70 another part of an electrical connector 76 is disposed within the opening 74 to connect with the other electrical connector 68 in the lower shaft portion 32. Electrical wires (not shown) extend from the electrical connector 68 through the opening 74 in the inner shaft housing 34 and out and through the upper shaft portion 30.

The inner shaft housing 34 also has between the first end 70 and second end 72 a threaded portion 78 on an external surface 80 thereof. The threaded portion 78 is used in conjunction with the threaded portion 50 and the adjustment member 38 to control the longitudinal movement of the connector 10 and the upper shaft portion 30 and the lower shaft portion 32. Also on the external surface 80 at the second end 72 is a rotational stop 82. As illustrated the rotational stop 82 is a projection that engages at least one rotational stop receiving member 48 in the opening 44 of the upper shaft portion 30 because the inner shaft housing 34 extends through the adjustment member 38 and into the opening 44 of the upper shaft portion 30. The rotational stop 82 can be disposed within the upper shaft portion 30 to restrict the rotational limits of the inner shaft housing 34 (which is connected to the ear cups 16) by engagement with the at least one rotational stop receiving member 48.

Also on the exterior surface 80 of the inner shaft housing 34 are preferably three O-rings 84 that are retained in corresponding grooves. The O-rings frictionally engage the interior of the upper shaft portion 30 to restrict the movement of the inner shaft housing 34 relative to the upper shaft portion 30.

Figure 11:
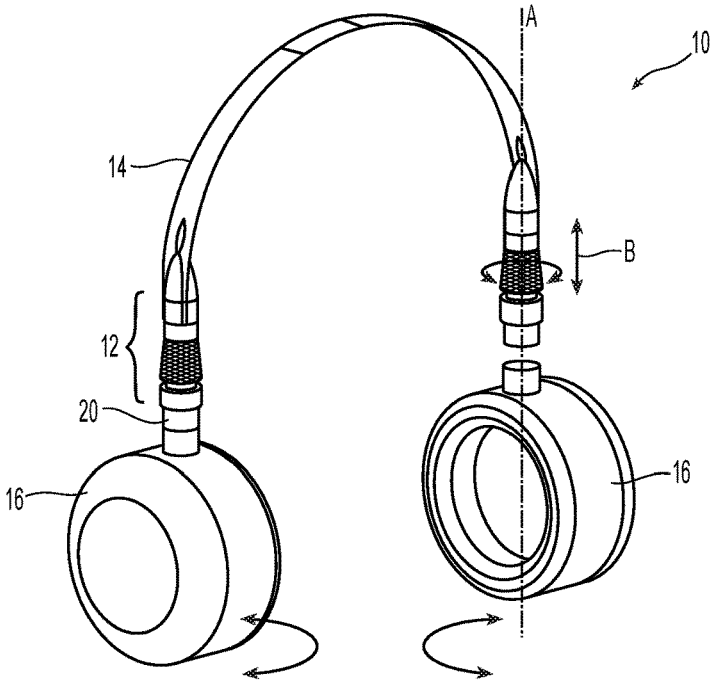
FIG. 11 is a perspective view of one embodiment of a set of headphones using connectors according to the present invention, where one ear cup support has been disconnected and illustrating the movement of the connectors in two axes.

The adjustment member 38 extends between a first end 90 and a second end 92 and has an opening 94 that extends between the first end 90 and second end 92 that is defined by an inside surface 96. On the inside surface 96 is at least one set of threads 98 to engage the threaded portions on the upper shaft portion 30 and the inner shaft housing 34. Turning the adjustment member 38 in one direction causes the ear cups 16 to move along the axis A toward the head band 14 and turning the adjustment member 38 in the other direction causes the ear cups 16 to move along the axis A away from the head band 14. The O-rings 84 noted above, along with the adjustment member 38, prevent the ear cups 16 from moving relative to the headband without operator action. Similarly, with the rotational stop 82 and the at least one rotational stop receiving member 48, the rotation of the ear cups 16 to the headband 14 can also be more controlled. Turning to FIG. 11, it can be seen that the movement of the ear cups 16 can be moved up and down along the axis A as illustrated by double headed arrow B. The rotation of the ear cups are preferably limited to 90° to the rear and 20 degrees to the front. This movement allows for comfortable wearing by the user but also allows for the headphones to be stored in a relatively small case.

Finally, the second part of the push-pull connector 100 is attached to the first end 70 of the inner shaft housing 34. As noted above, a push-pull connector is preferably used, and the second part 100 cooperates with the first portion at second end 64 of the lower shaft portion 32. Rather than the push/pull, other connectors may be used. These other connectors include connectors that have the following functionalities:) Push to release; B) Pull to release; C) Twist to release; D) Twist and Push to release; E) Twist and Pull to release It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

We claim:

1. A disconnectable connector housing comprising:

an upper shaft portion configured at a first end to be attached to a headband;

a lower shaft portion configured at a first end to be attached to an ear cup support and having at a second end one portion of a push-pull connector;

an inner shaft housing having an opening therethrough for the passage of electrical wires, the inner shaft housing having a first part of an electrical connector disposed in the opening at a first end and connectable to the electrical wires, a rotational stop disposed at a second end, and a second portion of the push-pull connector at the first end; and an adjustment member extending between a first end and a second, the adjustment member having an opening defined by an inside surface that extends from the first end to the second end, a portion of the upper shaft disposed within the opening at the first end and a portion of the inner shaft housing disposed within the opening, the inside surface having at least one set of threads therein, whereby the upper shaft portion moves away from the first end of the inner shaft housing when the adjustment member is rotated a first way and toward the first end of the inner shaft housing when the adjustment member is rotated a second way.

2. The disconnectable connector housing according to claim 1, wherein the inner shaft housing extends through the adjustable member and into an opening in the upper shaft portion.

3. The disconnectable connector housing according to claim 1, wherein the upper shaft portion has at least one rotational stop member, the at least one rotational stop receiving member to engage the rotational stop member in the inner shaft housing.

4. A disconnectable connector housing comprising:

an upper shaft portion;

a lower shaft portion having a first end and a second end, the second end being attached one portion of a connector;

an inner shaft housing having an opening therethrough for the passage of electrical wires, the inner shaft housing having a first part of an electrical connector disposed in the opening at a first end and connectable to the electrical wires, a rotational stop disposed at a second end, and a second portion of the push-pull connector at the first end; and an adjustment member extending between a first end and a second, the adjustment member having an opening defined by an inside surface that extends from the first end to the second end, a portion of the upper shaft disposed within the opening at the first end and a portion of the inner shaft housing disposed within the opening, the inside surface having at least one set of threads therein, whereby the upper shaft portion moves away from the first end of the inner shaft housing when the adjustment member is rotated a first way and toward the first end of the inner shaft housing when the adjustment member is rotated a second way.

* * * * *